US009611110B2

(12) United States Patent
Nishioka et al.

(10) Patent No.: US 9,611,110 B2
(45) Date of Patent: Apr. 4, 2017

(54) SHEET FEED CASSETTE, SHEET FEEDER, AND IMAGE FORMING APPARATUS

(71) Applicant: KYOCERA Document Solutions Inc., Osaka-shi (JP)

(72) Inventors: Nobuhiro Nishioka, Osaka (JP); Hironori Daigo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/727,705

(22) Filed: Jun. 1, 2015

(65) Prior Publication Data

US 2015/0353302 A1 Dec. 10, 2015

(30) Foreign Application Priority Data

Jun. 4, 2014 (JP) ..... 2014-115758

(51) Int. Cl.
*B65H 1/08* (2006.01)
*B65H 1/26* (2006.01)

(52) U.S. Cl.
CPC ..... *B65H 1/266* (2013.01); *B65H 1/08* (2013.01); *B65H 2403/533* (2013.01);
(Continued)

(58) Field of Classification Search
CPC .... B65H 1/08; B65H 1/12; B65H 2405/1117; B65H 2405/11172; B65H 2405/1142; B65H 2405/11425; B65H 2405/1144
(Continued)

(56) References Cited

U.S. PATENT DOCUMENTS 6,039,315 A * 3/2000 Lim ..... B65H 1/12 271/127
7,631,861 B2 * 12/2009 Takahashi ..... B41J 13/103 271/171
(Continued)

FOREIGN PATENT DOCUMENTS

JP S54-35648 U 3/1979
JP 02291324 A * 12/1990
(Continued)

OTHER PUBLICATIONS

An Office Action; "Notice of Reasons for Rejection," issued by the Japanese Patent Office on Apr. 19, 2016, which corresponds to Japanese Patent Application No. 2014-115758 and is related to U.S. Appl. No. 14/727,705.

*Primary Examiner* — Ernesto Suarez
(74) *Attorney, Agent, or Firm* — Studebaker & Brackett PC

(57) ABSTRACT

A sheet feed cassette includes a cassette main body, a sheet loading plate, a regulating member, and an auxiliary member. The sheet loading plate has a support surface and an opening. The support surface supports a sheet sheaf of one or more sheets. The regulating member is slidable within the opening in a sheet width direction perpendicular to a sheet feed direction. The regulating member regulates the sheet sheaf by coming into contact with an edge of the sheaf. The auxiliary member is supported by the sheet loading plate. The auxiliary member is in contact with the regulating member. The auxiliary member is turnable in parallel to the support surface in accompaniment to sliding of the regulating member. The auxiliary member supports a part of the sheet sheaf located over the opening.

19 Claims, 7 Drawing Sheets

(52) U.S. Cl.
CPC ... *B65H 2405/1117* (2013.01); *B65H 2511/12* (2013.01); *B65H 2511/22* (2013.01)

(58) Field of Classification Search
USPC ..... 271/171
See application file for complete search history.

(56) References Cited

U.S. PATENT DOCUMENTS 8,215,635 B2 * 7/2012 Wada ..... B65H 1/266
271/128
9,284,136 B1 * 3/2016 West ..... B65H 1/04

FOREIGN PATENT DOCUMENTS

JP H03-133837 A 6/1991
JP H09-124161 A 5/1997
JP 2009-007081 A 1/2009

* cited by examiner

SHEET FEED CASSETTE, SHEET FEEDER, AND IMAGE FORMING APPARATUS

INCORPORATION BY REFERENCE

The present application claims priority under 35 U.S.C. §119 to Japanese Patent Application No. 2014-115758, filed Jun. 4, 2014. The contents of this application are incorporated herein by reference in their entirety.

BACKGROUND

The present disclosure relates to sheet feed cassettes, sheet feeders, and image forming apparatuses.

A certain sheet feed cassette includes a sheet loading plate having an opening or a notch. The sheet feed cassette also includes side and end fences movable within the opening or the notch so that various sizes of sheets can be appropriately loaded in the sheet feed cassette. Position adjustment of the side and end fences can regulate various sizes of sheets. In a certain sheet feed cassette, an index mark indicative of an amount of currently stacked one or more sheets is provided on the side fence to enable a user to readily recognize variation in height of a sheet sheaf of one or more sheets loaded in the sheet feed cassette, so that the amount of stacked sheets can be restricted for each of sheet types.

SUMMARY

A paper feed cassette according to the present disclosure includes a cassette main body, a sheet loading plate, a regulating member, and an auxiliary member. The cassette main body has an open top end. The cassette main body includes a bottom plate and side walls standing up from the bottom plate. The cassette main body stores a sheet sheaf of one or more sheets. The sheet loading plate is supported in a tiltable manner by an upstream end of the bottom plate in the feed direction. The sheet loading plate has a support surface and an opening. The support surface supports the sheet sheaf. The regulating member is located on the bottom plate such as to project upward from the support surface of the sheet staking plate through the opening of the sheet loading plate. The regulating member is slidable within the opening in a sheet width direction perpendicular to the sheet feed direction. The regulating member regulates the sheet sheaf by coming in contact with an edge of the sheet sheaf in the sheet width direction. The auxiliary member is supported by the sheet loading plate. The auxiliary member is in contact with the regulating member. The auxiliary member is turnable in parallel to the support surface of the sheet loading plate in accompaniment to sliding of the regulating member. The auxiliary member is turnable in parallel to the support surface of the sheet loading plate in accompaniment to the sliding of the regulating member. The auxiliary member supports a part of the sheet sheaf located over the opening.

A sheet feeder according to the present disclosure includes the above paper feed cassette, a feed member, and a paper feed cassette accommodating section. The feed member feeds a sheet sheaf loaded on the paper feed cassette. The sheet feed cassette accommodating section accommodates the sheet feed cassette.

An image forming apparatus according to the present disclosure includes the sheet feeder as described above and an image forming section. The image forming section forms an image on a sheet fed from the sheet feeder.

DETAILED DESCRIPTION

Figure 1A:
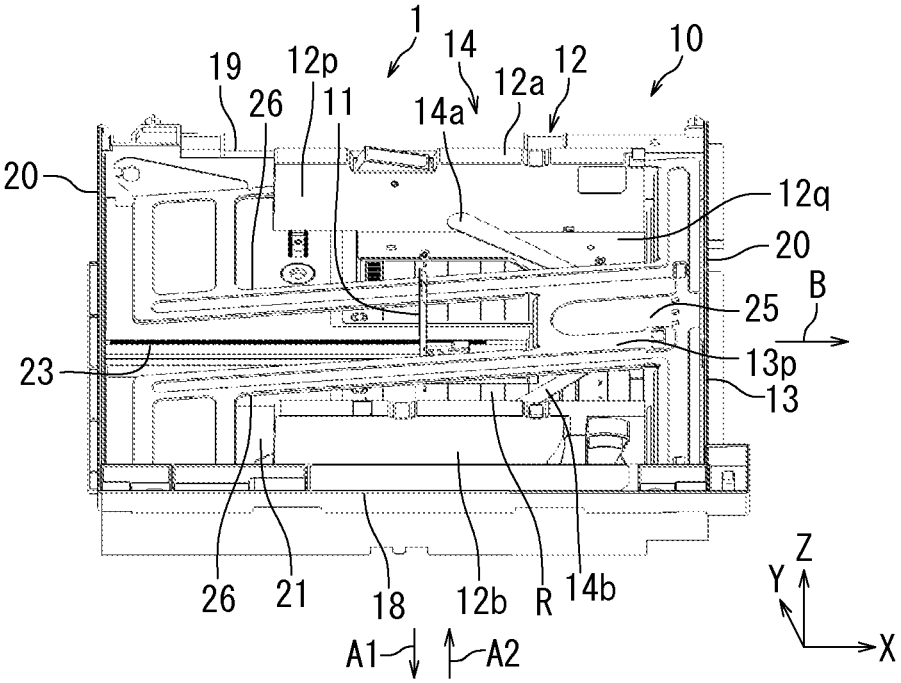
FIG. 1A is a perspective view of a sheet feed cassette according to a first embodiment of the present disclosure.

The following describes embodiments of the present disclosure by way of several examples, with reference to the accompanying drawings. Like reference sings denote like elements or corresponding elements in the drawings, and repeated description shall be omitted.

First Embodiment

Figure 1B:
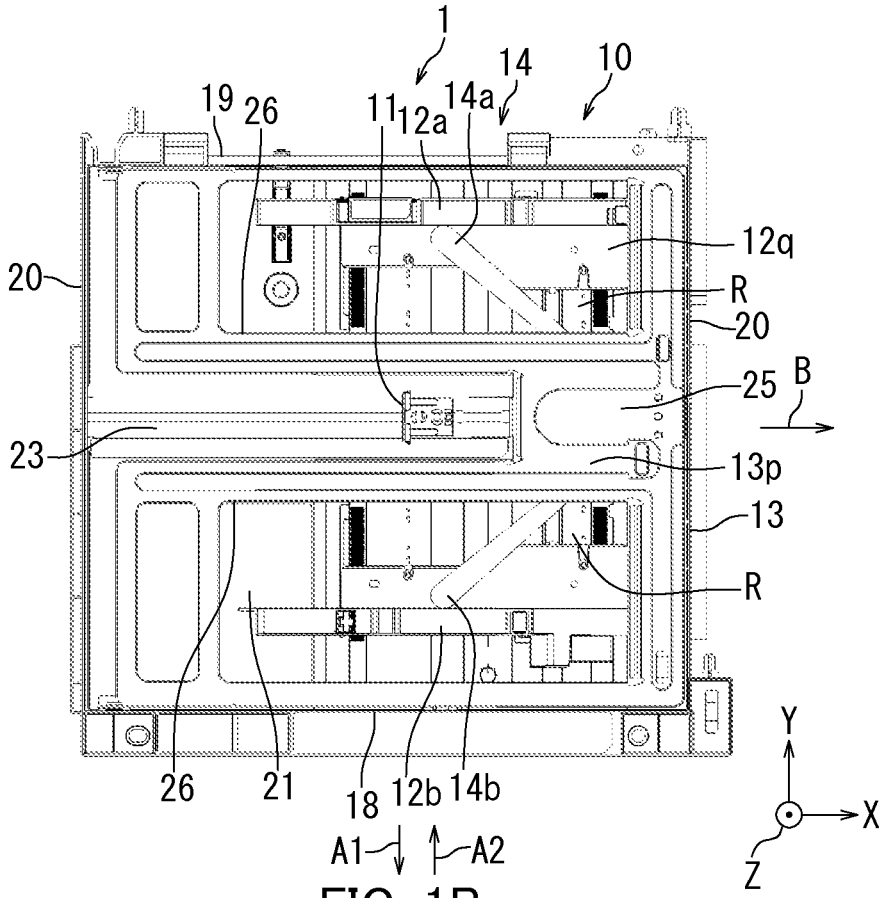
FIG. 1B is a plan view of the sheet feed cassette according to the first embodiment of the present disclosure.

A sheet feed cassette 1 according to a first embodiment of the present disclosure will be described with reference to FIGS. 1A and 1B. FIG. 1A is a perspective view of the sheet feed cassette 1. FIG. 1B is a plan view of the sheet feed cassette 1. In FIGS. 1A and 1B, the X and Y axes are perpendicular to each other and parallel to a horizontal plane and the Z axis is parallel to the vertical direction. The sheet feed cassette 1 includes a cassette main body 10, a rear edge regulating member 11, a regulating member 12, a sheet loading plate 13, and an auxiliary member 14.

The cassette main body 10 is fitted into an image forming apparatus in a freely detachable manner. A sheet sheaf of one or more sheets is loaded in the cassette main body 10. The cassette main body 10 is moved in a drawing-out direction A1 to be pulled out from the image forming apparatus. The cassette main body 10 is moved in an insertion direction A2 to be inserted into the image forming apparatus. The sheets are fed in a sheet feed direction B.

The positive direction along the X axis coincides with the sheet feed direction B. The positive and negative directions along the Y axis agree with backward and forward directions with respect to the cassette main body 10, respectively.

The cassette main body 10 of the sheet feed cassette 1 is in a rectangular parallelepiped shape having an open top end. The cassette main body 10 includes a front wall 18 and a rear wall 19 that are parallel to the sheet feed direction B, a pair of side walls 20 that are perpendicular to the sheet feed direction B, and a bottom plate 21. The bottom plate 21 is in a rectangular plate shape in parallel to an XY plane. The front wall 18 stands up from the front end of the bottom plate 21 and extends along the X axis. The rear wall 19 stands up from the rear end of the bottom plate 21 to face the front wall 18 and extends along the X axis. The side walls 20 stand up from respective side ends of the bottom plate 21 in the sheet feed direction B to face each other and extend along the Y axis that coincides with a sheet width direction. The cassette main body 10 serves as a sheet storage section.

The rear edge regulating member 11 is in a plate shape standing up along the Z axis that coincides with a sheet loading direction. The rear edge regulating member 11 has an engaging claw at a lower part thereof. The bottom plate 21 of the cassette main body 10 includes a guide 23 having ratchet teeth. The guide 23 extends along the X axis that coincides with the sheet feed direction B. The rear edge regulating member 11 is movable along the guide 23. The engaging claw engages with any one of the ratchet teeth in a releasable manner. In the configuration as above, the rear edge regulating member 11 is capable of being fixed at any point along the guide 23.

The regulating member 12 is located on the bottom plate 21 of the cassette main body 10. The regulating member 12 comes in contact with respective side edges of the sheet sheaf in the sheet width direction perpendicular to the sheet feed direction B to regulate the sheet sheaf.

The regulating member 12 in the present embodiment includes a pair of side edge regulating walls 12*a* and 12*b*. The side edge regulating walls 12*a* and 12*b* each have a plate shape and face each other. The regulating member 12, that is, each of the side edge regulating walls 12*a* and 12*b* has a regulating surface 12*p* and a stacking surface 12*q*. In a situation in which a sheet sheaf of one or more sheets is loaded on the sheet feed cassette 1, the stacking surface 12*q* is in contact with a part of the sheet sheaf to support the sheet sheaf and the regulating surface 12*p* is in contact with a side surface of the sheet sheaf to regulate the sheet sheaf.

The regulating surface 12*p* is perpendicular to the stacking surface 12*q*. The stacking surface 12*q* is parallel to an XY plane, while the regulating surface 12*p* stands up from the stacking surface 12*q* along the Z axis. The regulating surface 12*p* and the stacking surface 12*q* extend along the X axis.

The each of side edge regulating walls 12*a* and 12*b* is connected to a rack-and-pinion mechanism located at the bottom plate 21 of the cassette main body 10. In the configuration as above, the side edge regulating walls 12*a* and 12*b* are interlocked with each other so as to be slidable in directions approaching and separating from each other in the direction along the Y axis perpendicular to the sheet feed direction B.

The sheet loading plate 13 is a plate member located on the upper surface of the bottom plate 21 of the cassette main body 10. The sheet loading plate 13 has a downstream end in the sheet feed direction B that is tiltable about an upstream end of the bottom plate 21 in the sheet feed direction B. The sheet loading plate 13 has a central part in the sheet width direction that has a notch extending in the sheet feed direction B. The rear edge regulating member 11 is located within the notch. In the configuration as above, the sheet loading plate 13 does not inhibit movement of the rear edge regulating member 11.

In addition, the sheet loading plate 13 has a pair of rectangular openings R corresponding to the pair of side edge regulating walls 12*a* and 12*b* within which the respective side edge regulating walls 12*a* and 12*b* are allowed to move. The side edge regulating walls 12*a* and 12*b* each protrude upward from an support surface (upper surface) 13*p* of the sheet loading plate 13 through a corresponding one of the openings R of the sheet loading plate 13 and each are slidable in the sheet width direction within a corresponding one of the openings R. In the configuration as above, the sheet loading plate 13 does not inhibit movement of the side edge regulating walls 12*a* and 12*b*.

One or more sheets to be fed are loaded on the sheet loading plate 13. Specifically, a sheet sheaf of one or more sheets is loaded on the support surface 13*p* of the sheet loading plate 13, the stacking surfaces 12*q* of the side edge regulating walls 12*a* and 12*b*, and the upper surface of the bottom plate 21 of the cassette main body 10, which serve in combination as a loading surface. The support surface 13*p* of the sheet loading plate 13 has the openings R.

The rear edge regulating member 11 regulates the rear edge of the sheet sheaf loaded on the loading surface. One of the side edge regulating walls 12*a* and 12*b* comes in contact with one of the side edges of the sheet sheaf loaded on the loading surface. The other of the side edge regulating walls 12*a* and 12*b* comes in contact with the other of the side edges of the sheet sheaf loaded on the loading surface. The position of the sheet sheaf is restricted accordingly. In the configuration as above, the rear edge regulating member 11 and the pair of side edge regulating walls 12*a* and 12*b* regulate the sheet sheaf loaded in the cassette main body 10 according to the sheet size of the sheet sheaf. Moving the rear edge regulating member 11 and/or the pair of side edge regulating walls 12*a* and 12*b* according to the sheet size of the sheet sheaf loaded on the cassette main body 10 can restrict the position of sheet sheaves of different sizes.

Opposite end portions of the sheet loading plate 13 in the sheet width direction at an upstream end part in the sheet feed direction B are supported at the front and rear walls 18 and 19 of the cassette main body 10 so that the sheet loading plate 13 is tiltable. A downstream end part of the sheet loading plate 13 in the sheet feed direction B is urged by a drive section such as a motor or a spring toward a sheet feed roller located thereabove. In the configuration as above, the lower surface of the sheet loading plate 13 is in contact with the upper surface of the bottom plate 21 of the cassette main body 10 in a situation in which the number of sheets loaded on the sheet loading plate 13 is large, so that the sheet loading plate 13 is laid substantially horizontally and is tilted up and inclined as the amount of loaded sheets decreases. Therefore, the tilt angle of the sheet loading plate 13 with respect to a horizontal plane increases as the amount of loaded sheets decreases.

The auxiliary member 14 is supported by the sheet loading plate 13 in contact with the regulating member 12. The auxiliary member 14 is arranged such that a downstream end portion thereof in the sheet feed direction B is located at the central part in the sheet width direction in a downstream part in the sheet feed direction B in the lower surface of the sheet loading plate 13. An upstream portion of the auxiliary member 14 in the sheet feed direction B turns in a direction parallel to the sheet loading plate 13.

The auxiliary member 14 in the present embodiment includes a pair of first and second auxiliary plates 14*a* and 14*b*. Each of the first and second auxiliary plates 14*a* and 14*b* is thin in thickness and long in length. The first and second auxiliary plates 14*a* and 14*b* may be plated, for example. The first and second auxiliary plates 14*a* and 14*b* support a sheet sheaf loaded on the sheet loading plate 13 in cooperation with the sheet loading plate 13. In a configuration with the first and second auxiliary plates 14*a* and 14*b* as the auxiliary member 14, both of the opposite side parts of the sheet sheaf in the sheet feed direction can be supported. The first and second auxiliary plates 14*a* and 14*b* each have an upstream end portion and a downstream end portion. The upstream end portions of the first and second auxiliary plates 14*a* and 14*b* each are in contact with a corresponding one of the regulating surfaces 12*p* of the side edge regulating walls 12*a* and 12*b* and each slide on the corresponding one of the regulating surfaces 12*p* of the side edge regulating walls 12*a* and 12*b* in a direction perpendicular to the sheet width direction in accompaniment to movement of the side edge regulating walls 12*a* and 12*b*. The first and second auxiliary plates 14*a* and 14*b* each turn on a corresponding one of the stacking surfaces 12*q* of the first and second side edge regulating walls 12*a* and 12*b* about respective downstream end portions of the first and second auxiliary plates 12*a* and 12*b* in accompaniment to sliding of the side edge regulating walls 12*a* and 12*b*.

Figure 2A:
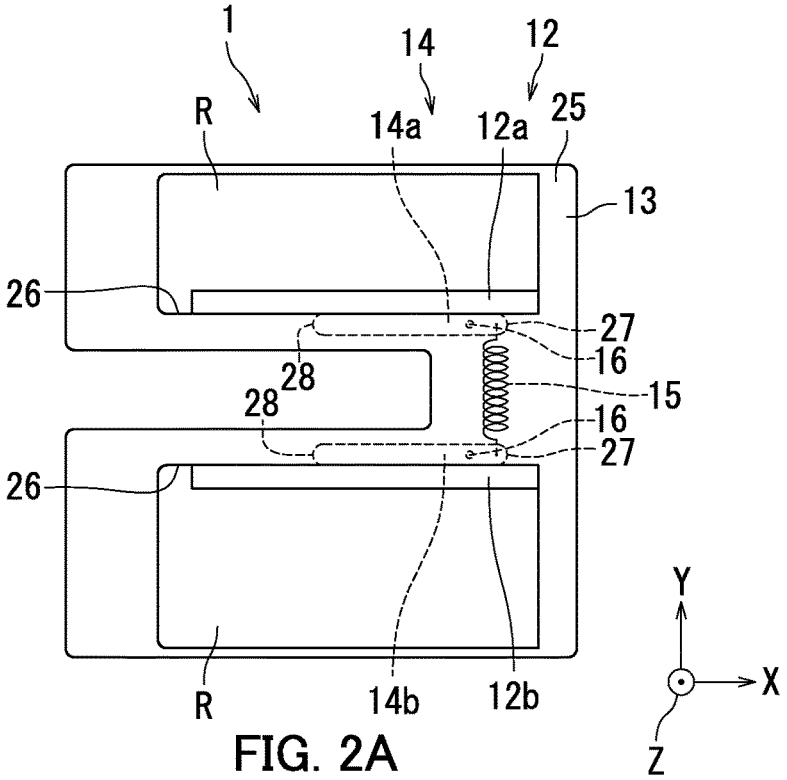
FIGS. 2A and 2B are schematic plan views each illustrating the sheet feed cassette according to the first embodiment of the present disclosure.
Figure 2B:
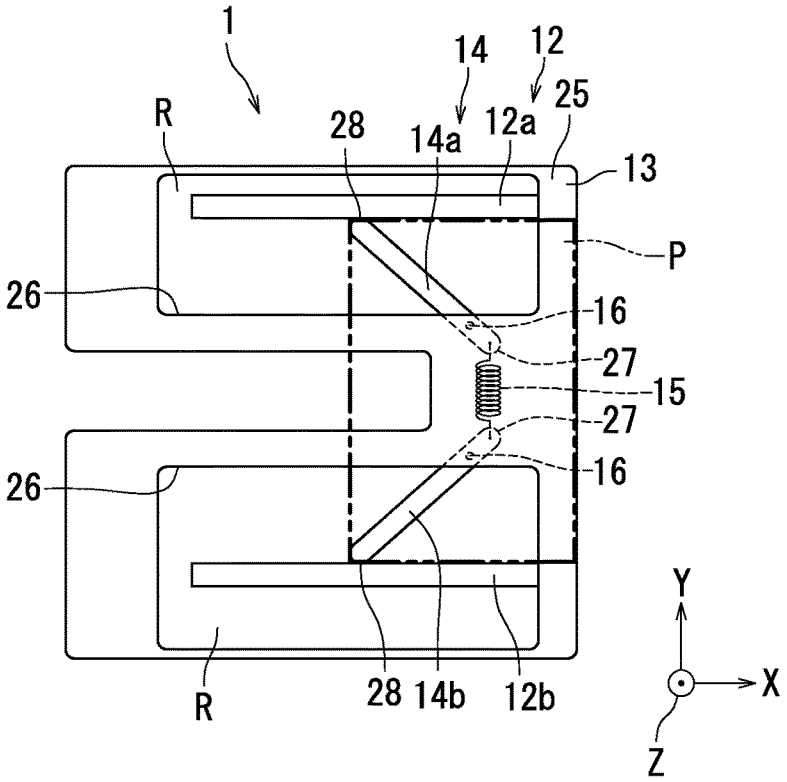

Description will be made about an operation of the auxiliary member 14 (the first and second auxiliary plates 14*a* and 14*b*) of the sheet feed cassette 1 according to a first embodiment of the present disclosure with reference to FIGS. 2A and 2B. FIGS. 2A and 2B are schematic plan views each illustrating the sheet feed cassette 1.

The sheet feed cassette 1 further includes an urging member 15. Each of the first and second auxiliary plates 14*a* and 14*b* includes a first end portion 27 corresponding to the downstream end portion, a second end portion 28 corresponding to the upstream end portion, and a supported portion 16. The first end portion 27 is located downstream in the sheet feed direction B. The second end portion 28 is located upstream in the sheet feed direction B. The supported portion 16 is located between the first end portion 27 and the second end portion 28. The first and second auxiliary plates 14*a* and 14*b* are mounted on and supported by the sheet loading plate 13 at the respective supported portions 16. The first and second auxiliary plates 14*a* and 14*a* of the auxiliary member 14 in the present embodiment are connected together at the respective first end portions 27 through the urging member 15. The urging member 15 may be a spring, for example. A force of the urging member 15 acts on the respective first end portions 27 of the first and second auxiliary plates 14*a* and 14*b* in directions in which the first end portions 27 approach each other along the Y axis. In the configuration as above, a force in directions in which the second end portions 28 of the first and second auxiliary plates 14*a* and 14*b* separate from each other along the Y axis acts on the respective second end portions 28. The urging member 15 urges the first and second auxiliary plates 14*a* and 14*b* to cause the first and second auxiliary plates 14*a* and 14*b* to be in contact with the respective side surfaces of the side edge regulating walls 12*a* and 12*b*. In the configuration as above, the urging member 15 urges the first end portions 27 to turn the second end portions 28 about the respective supported portions 16, thereby causing the second end portions 28 to push the side surfaces of the side edge regulating walls 12*a* and 12*b*.

As illustrated in FIG. 2A, in a situation in which the distance between the side edge regulating walls 12*a* and 12*b* is small, the first and second auxiliary plates 14*a* and 14*b* are substantially parallel to each other along the X axis.

As illustrated in FIG. 2B, as the side edge regulating walls 12*a* and 12*b* slide in respective outward directions, the first and second auxiliary plates 14*a* and 14*b* turns about the respective supported portions 16 while in contact with the corresponding side edge regulating walls 12*a* and 12*b*. In the configuration as above, the first and second auxiliary plates 14*a* and 14*b* move while changing overlaps of the first and second auxiliary plates 14*a* and 14*b* with the openings R in accompaniment to sliding of the side edge regulating walls 12*a* and 12*b*. Specifically, the more the side edge regulating walls 12*a* and 12*b* slide outward, the more the first and second auxiliary plates 14*a* and 14*b* advance into the respective openings R. The area of a part of a sheet P in contact with the first and second auxiliary plates 14*a* and 14*b* increases accordingly.

As described above with reference to FIGS. 1A to 2B, the sheet feed cassette 1 includes the cassette main body 10, the sheet loading plate 13, the regulating member 12 (the first and second side edge regulating walls 12*a* and 12*b*), and the auxiliary member 14 (the first and second auxiliary plates 14*a* and 14*b*). In accompaniment to sliding of the regulating member 12, the sheet loading plate 13 is connected to the regulating member 12 through the auxiliary member 14 through the openings R. In the configuration as above, even when the width of the openings R varies in accompaniment to sliding of the regulating member 12, the auxiliary member 14 blocks a part of each of the openings R. As a result, a sheet P can be prevented from sagging, while occurrence of non-sheet feeding or skew can be reduced.

The auxiliary member 14 urges the regulating member 12 while in contact with the regulating member 12. This configuration can move the auxiliary member 14 in accompaniment to sliding of regulating member 12.

The auxiliary member 14 is located on the lower surface of the sheet loading plate 13. This configuration can prevent interference of the auxiliary member 14 with a sheet P and reduce friction between the auxiliary member 14 and the sheet P during turning of the auxiliary member 14 in accompaniment to the sliding of the regulating member 12. As a result, the auxiliary member 14 can move smoothly.

Second Embodiment

Figure 3:
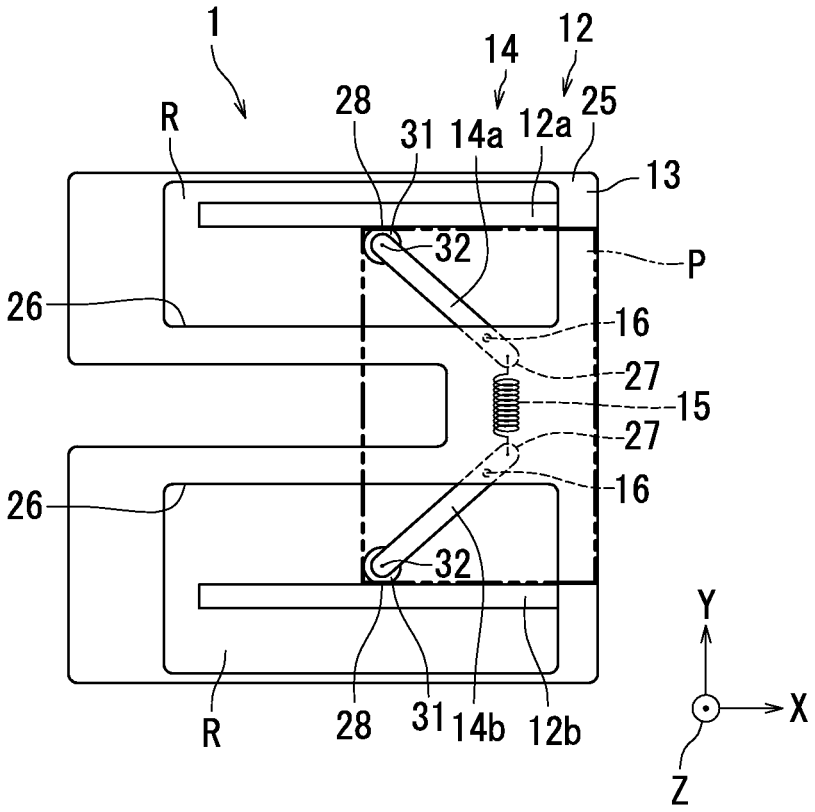
FIG. 3 is a schematic plan view illustrating a sheet feed cassette according to a second embodiment of the present disclosure.

A sheet feed cassette 1 according to a second embodiment of the present disclosure will be described with reference to FIG. 3. FIG. 3 is a schematic plan view illustrating the sheet feed cassette 1. The sheet feed cassette 1 has a similar configuration to that of the sheet feed cassette 1 according to the first embodiment, but additionally includes sliding members 31. Therefore, repeated description is omitted.

The sheet feed cassette 1 further includes sliding members 31 each located at a tip end of a corresponding one of the first and second auxiliary plates 14*a* and 14*b*. The respective sliding members 31 are in contact with and slides on the respective side edge regulating walls 12*a* and 12*b* in the direction perpendicular to the sheet width direction. Each of the sliding members 31 is a rotor. The respective sliding members 31 are connected to the respective the first and second auxiliary plates 14*a* and 14*b* through shafts 32. During turning of the first and second auxiliary plates 14*a* and 14*b* in accompaniment to sliding of the side edge regulating walls 12*a* and 12*b*, the respective sliding members 31 rotate while in contact with the respective side edge regulating walls 12*a* and 12*b*. In the configuration as above, friction between the first and second auxiliary plates 14*a* and 14*b* and the side edge regulating walls 12*a* and 12*b* can be reduced, thereby achieving smooth movement of the first and second auxiliary plates 14*a* and 14*b*.

Third Embodiment

Figure 4A:
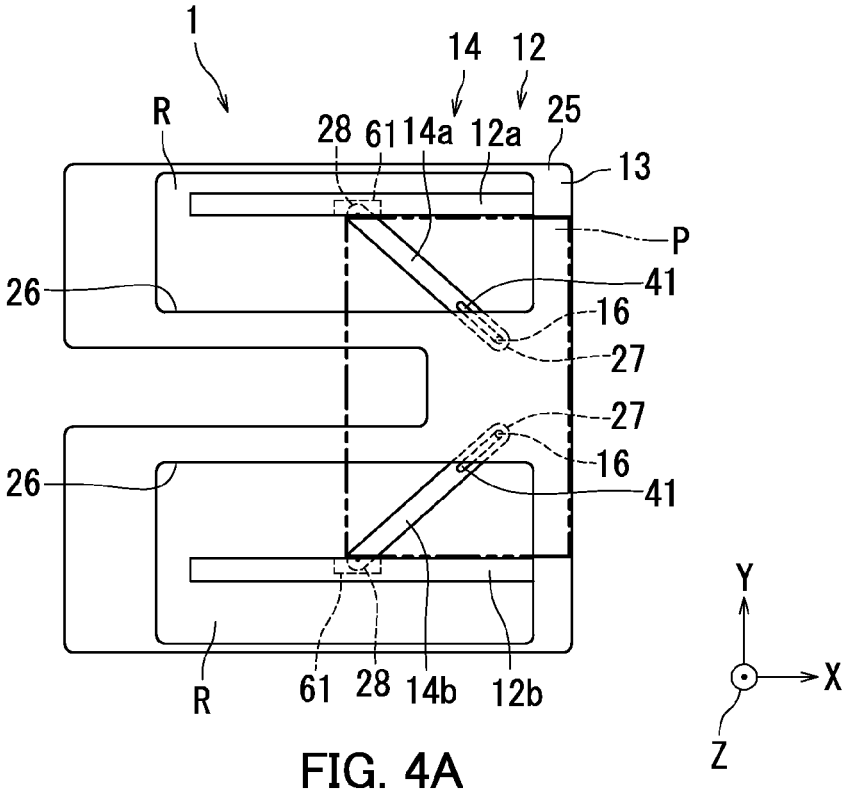
FIGS. 4A and 4B are schematic plan views each illustrating a sheet feed cassette according to a third embodiment of the present disclosure.
Figure 4B:
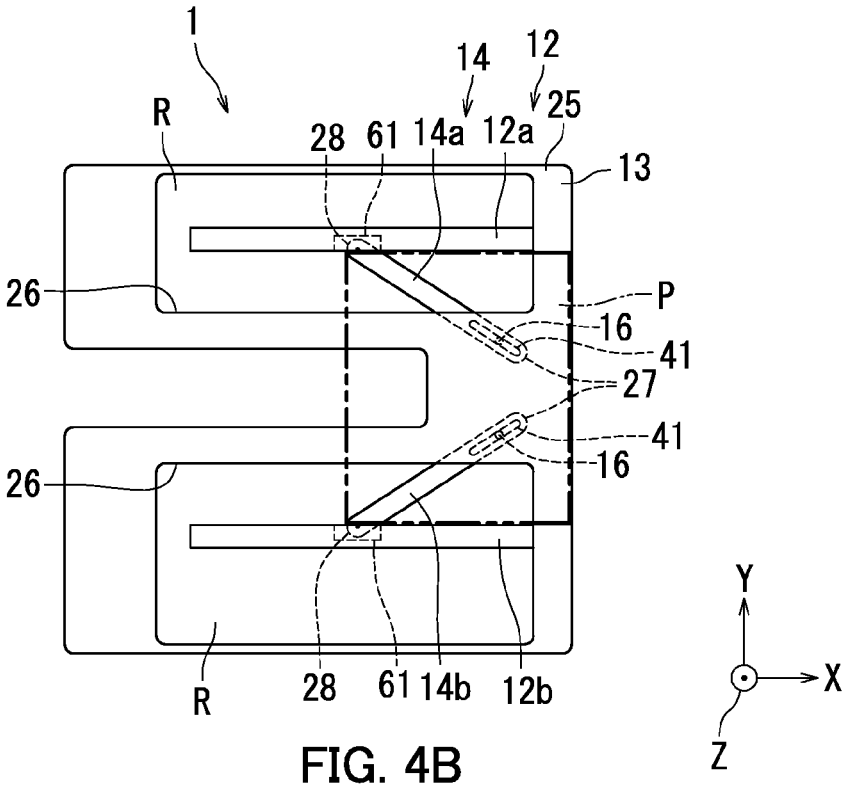
Figure 5:
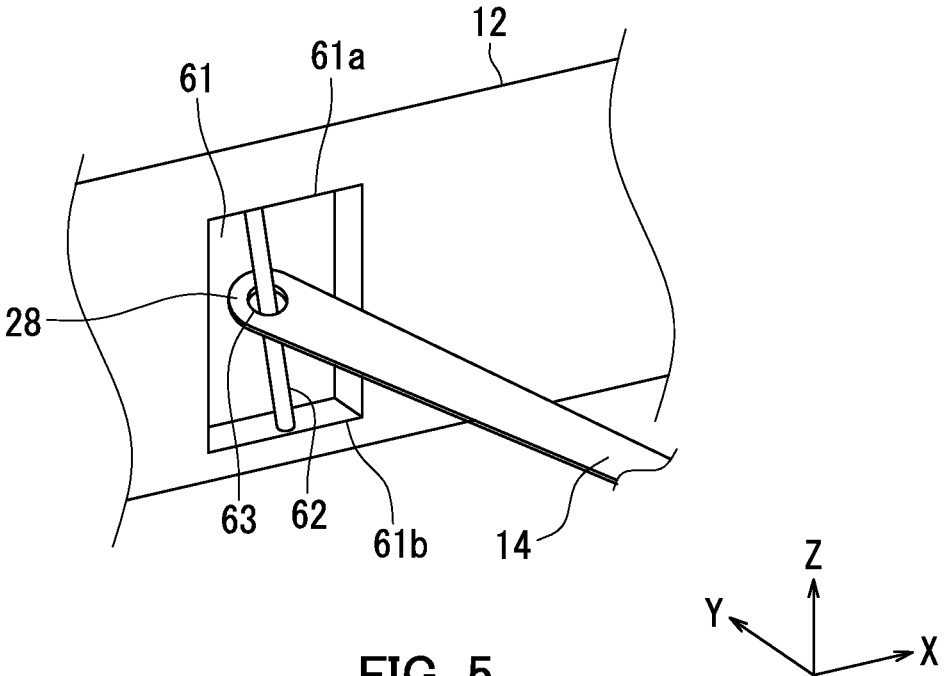
FIG. 5 is a schematic perspective view illustrating a joint portion between an auxiliary member and a regulating member.

Description will be made next about a sheet feed cassette 1 according to a third embodiment of the present disclosure with reference to FIGS. 4A, 4B, and 5. FIGS. 4A and 4B are schematic plan views each illustrating the sheet feed cassette 1. FIG. 5 is a schematic perspective view illustrating a joint portion between the auxiliary member 14 and the regulating member 12. The sheet feed cassette 1 has a configuration similar to that of the sheet feed cassette 1 according to the first embodiment except that the sheet feed cassette 1 includes no urging member 15 and the auxiliary member 14 is joined to the regulating member 12. Therefore, duplicate description is omitted.

As illustrated in FIGS. 4A, 4B, and 5, each of the side edge regulating walls 12*a* and 12*b* has a recessed portion 61. The recessed portion 61 has an upper surface 61*a* and a lower surface 61*b*. The first and second auxiliary plates 14*a* and 14*b* are capable of being contact with the recessed portion 61. Each of the side edge regulating walls 12*a* and 12*b* further includes a shaft 62 located within the corresponding recessed portion 61. The shaft 62 is supported at the upper surface 61*a* and the lower surface 61*b*. The shaft 62 inclines toward upstream in the sheet feed direction according to variation in inclination of the tilting sheet loading plate 13. The second end portion 28 of each of the first and second auxiliary plates 14*a* and 14*b* has an opening 63. The opening 63 is large enough to allow a corresponding one of the first and second auxiliary plates 14*a* or 14*b* to be movable even when an angle of the first and second auxiliary plates 14*a* and 14*b* with respect to a horizontal plane varies by tilting of the sheet loading plate 13. The first and second auxiliary plates 14*a* and 14*b* are each joined to a corresponding one of the side edge regulating walls 12*a* and 12*b* through the shaft 62 such that the shaft 62 passes through the opening 63. Each of the first and second auxiliary plates 14*a* and 14*b* is turnable with the shaft 62 passing through the opening 63, and supported pivotally in a slidable manner in the axial direction of the shaft 62. In the present embodiment, each of the first and second auxiliary plates 14*a* and 14*b* turns about the shaft 62. The first and second auxiliary plates 14*a* and 14*b* ascend and descend in accompaniment to tilting of the sheet loading plate 13 while changing respective positional relationships with the recessed portion 61 in contact therewith. Further, as illustrated in FIGS. 4A and 4B, the first and second auxiliary plates 14*a* and 14*b* each have a groove 41. Sliding of the side edge regulating walls 12*a* and 12*b* changes a positional relationship between the supported portion 16 and the groove 41 in each of the first and second auxiliary plates 14*a* and 14*b*. Through the respective first and second auxiliary plates 14*a* and 14*b* being joined to the respective side edge regulating walls 12*a* and 12*b*, the need of the urging member 15 can be eliminated.

Fourth Embodiment

The sheet feed cassettes 1 according to the first to third embodiments each include two auxiliary plates 14*a* and 14*b* as the auxiliary member 14 and two side edge regulating walls 12*a* and 12*b* as the regulating member 14, but may include a single auxiliary plate and a single side edge regulating wall.

Figure 6:
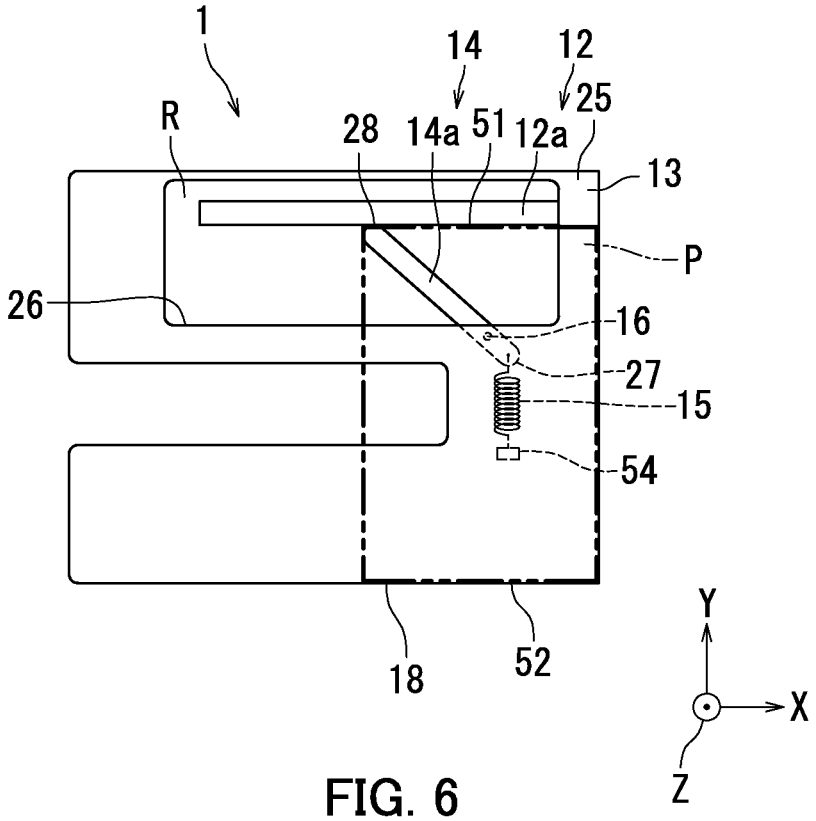
FIG. 6 is a schematic plan view illustrating a sheet feed cassette according to a fourth embodiment of the present disclosure.

A sheet feed cassette 1 according to a fourth embodiment of the present disclosure will be described with reference to FIG. 6. FIG. 6 is a schematic plan view illustrating the sheet feed cassette 1. The sheet feed cassette 1 has a configuration similar to that of the sheet feed cassette 1 in the first embodiment except that: the sheet feed cassette 1 has a single opening R; the auxiliary member 14 includes a single auxiliary plate 14*a*; and the regulating member 12 includes a single side edge regulating wall 12*a*. Therefore, duplicate description is omitted.

One side edge 51 of a sheet P in the sheet width direction is in contact with the side edge regulating wall 12*a*. Another other side edge 52 of the sheet P is in contact with the front wall 18 of the cassette main body 10. The urging member 15 has an end portion fixed to the auxiliary plate 14*a* and another end portion fixed to the sheet loading plate 13. Likewise in the first to third embodiments, even when the width of the opening R varies in accompaniment to sliding of the side edge regulating wall 12*a*, the auxiliary plate 14*a* blocks part of the opening R.

Fifth Embodiment

Figure 7:
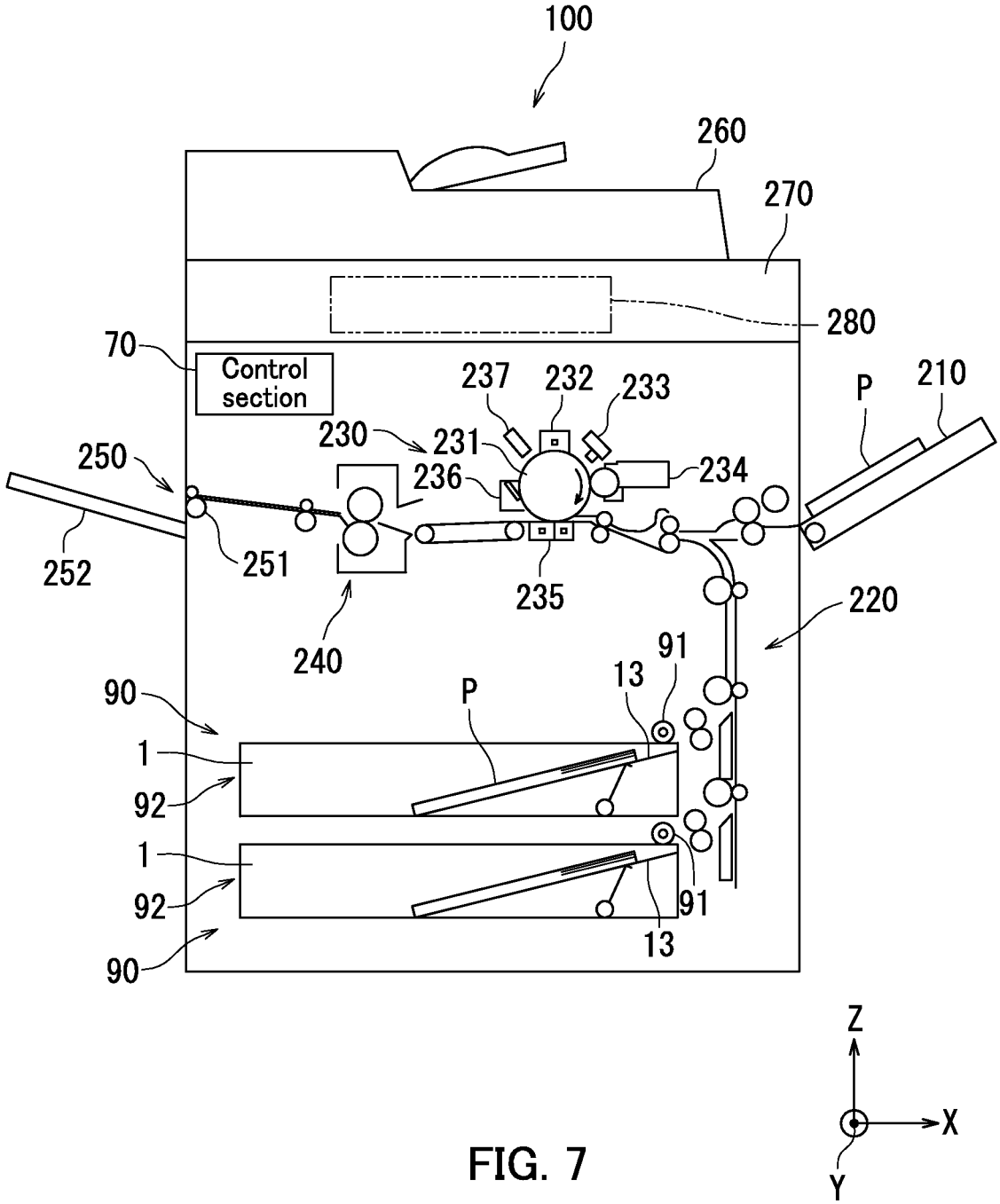
FIG. 7 is a schematic cross sectional view for explaining a configuration of an image forming apparatus according to a fifth embodiment of the present disclosure.

An image forming apparatus 100 according to a fifth embodiment of the present disclosure will be described with reference to FIG. 7. FIG. 7 is a schematic cross sectional view for explaining a configuration of the image forming apparatus 100. The image forming apparatus 100 may be a copier, a printer, or a multifunction peripheral, for example. Such a multifunction peripheral has at least two functions among copying, printing, and faxing, for example.

The image forming apparatus 100 includes a sheet feeder 90, a conveyance section 220, an image forming section 230, a fixing section 240, an ejection section 250, an original document conveyance section 260, an image reading section 270, an operation section 280, and a control section 70. The sheet feeder 90 includes a sheet feed cassette 1, a feed member 91, a feed cassette accommodating section 92. The sheet feed cassette 1 is the same as the sheet feed cassette 1 according to any one of the first to fourth embodiments. The sheet feed cassette 1 further includes a manual feed tray 210. The feed member 91 feeds a sheet P loaded on the sheet feed cassette 1. The feed member 91 may be a pickup roller, for example. The cassette accommodating section 92 accommodates the sheet feed cassette 1.

The operation section 280 outputs control signals in response to a user's operation to the control section 70. The user's operation may be an operation for any of various settings to the image forming apparatus 100.

The control section 70 includes, for example, a central processing unit (CPU) and a storage section, which are not illustrated. The storage section includes a main storage device (e.g., a semiconductor memory) and an auxiliary storage device (e.g., a semiconductor memory or a hard disk drive) according to specification.

In accordance with a computer program or control signals from the operation section 280, the control section 70 controls the sheet feeder 90, the conveyance section 220, the image forming section 230, the fixing section 240, the ejection section 250, the original document conveyance section 260, the image reading section 270, and the operation section 280.

The original document conveyance section 260 conveys an original document to the image reading section 270. The image reading section 270 generates image data by reading an image of the original document. The sheet feeder 90 feeds a sheet P to the conveyance section 220 from the sheet feed cassette 1 or the manual feed tray 210. The sheet P may be, for example, plain paper, recycled paper, thin paper, thick paper, coated paper, an overhead projector (OHP) sheet, or the like.

The conveyance section 220 conveys the sheet P to the image forming section 230. The image forming section 230 forms (prints) an image on the sheet P fed from the sheet feeder 90 via the conveyance section 220. The image forming section 230 includes a photosensitive drum 231, a charger 232, an exposure section 233, a development section 234, a transfer section 235, a cleaning section 236, and a static eliminating section 237. A specific operation of the image forming section 230 is as follows.

The charger 232 electrostatically charges the surface of the photosensitive drum 231. The exposure section 233 irradiates the surface of the photosensitive drum 231 with light based on image data. As a result, an electrostatic latent image corresponding to the image data is formed on the surface of the photosensitive drum 231. The image data may be any of image data generated by the image reading section 270, image data stored in the storage section, and image data transmitted from an external device (not illustrated) via a network (not illustrated), for example.

The development section 234 forms a toner image on the surface of the photosensitive drum 231 by causing toner to be attached to the electrostatic latent image. The transfer section 235 transfers the toner image to the sheet P. The cleaning section 236 removes toner remaining on the surface of the photosensitive drum 231. The static eliminating section 237 removes residual charge on the surface of the photosensitive drum 231.

The sheet P to which the toner image is transferred is conveyed to the fixing section 240. The fixing section 240 applies heat and pressure to the sheet P to fix the toner image to the sheet P. The sheet P to which the toner image is transferred is conveyed to the ejection section 250. The ejection section 250 includes an ejection roller pair 251 and an exit tray 252. The ejection roller pair 251 ejects the sheet P onto the exit tray 252.

As described with reference to FIG. 7, the image forming apparatus 100 according to the present embodiment includes the sheet feed cassette 1 according to any one of the first to fourth embodiments. Accordingly, the sheet P can be prevented from sagging, while occurrence of non-sheet feeding or skew can be reduced in the same way as in the first to fourth embodiments. Besides, the fifth embodiment can bring the same advantages as those in the first to fourth embodiments.

The embodiments of the present disclosure have been described so far with reference to FIGS. 1-7. Note that the present disclosure is not limited to the above embodiments, and a wide range of alterations can be made to the embodiments so long as such alterations do not deviate from the intended scope of the present disclosure (e.g., (1) to (3) below). The drawings are schematic illustrations that emphasize elements of configuration in order to facilitate understanding thereof. Therefore, properties of each of the elements in the above embodiments, such as thickness, length, and number thereof, may differ from actual properties of the element. The properties of each of the elements, such as material, shape, and dimension thereof described above are mere examples and not limited specifically. A wide range of variations of the properties can be made to the embodiments so long as such variations do not deviate from the intended scope of the present disclosure.

(1) In the sheet feed cassette 1 in each of the first to fourth embodiments, the auxiliary member 14 is located on the lower surface of the sheet loading plate 13, but may be located on the upper surface thereof.

(2) In the sheet feed cassette 1 in each of the first to fourth embodiments, the sheet loading plate 13 may have notch(es) rather than the opening(s) R.

(3) In the sheet feed cassette 1 in each of the first to fourth embodiments, the side edge regulating walls 12*a* and 12*b* each have the stacking surface 12*q* in addition to the regulating surface 12*p*, but may have the regulating surface 12*p* only without the stacking surface 12*q*.

What is claimed is:

1. A sheet feed cassette comprising:

a cassette main body with an open top end that includes a bottom plate and side walls standing up from the bottom plate and that is configured to store a sheet sheaf of one or more sheets;

a sheet loading plate supported in a tiltable manner about an upstream end of the bottom plate in a sheet feed direction and having an opening and a support surface that supports the sheet sheaf;

a regulating member that is located on the bottom plate such as to protrude upward from the support surface of the sheet loading plate through the opening of the sheet loading plate, that is configured to be slidable within the opening in a sheet width direction perpendicular to the sheet feed direction, and that includes a regulating surface regulating the sheet sheaf by coming into contact with an edge of the sheet sheaf in the sheet width direction; and an auxiliary member including a supported portion supported by the sheet loading plate, the auxiliary member being in contact with the regulating surface of the regulating member, wherein the auxiliary member is turnable in parallel to the support surface of the sheet loading plate about the supported portion as a center, the auxiliary member turns in accompaniment to sliding of the regulating member, and the auxiliary member supports the sheet sheaf by being in contact with a part of the sheet sheaf located over the opening.

2. The sheet feed cassette according to claim 1, wherein the auxiliary member has an elongated shape, and the auxiliary member includes:

a first end portion located downstream in the sheet feed direction;

a second end portion located upstream in the sheet feed direction and in contact with the regulating member, and the supported portion is located between the first end portion and the second end portion.

3. The sheet feed cassette according to claim 2, further comprising an urging member configured to urge the auxiliary member, wherein the urging member urges the first end portion of the auxiliary member to turn the second end portion of the auxiliary member so that the second end portion of the auxiliary member pushes the regulating surface of the regulating member.

4. The sheet feed cassette according to claim 2, wherein the second end portion of the auxiliary member is configured to be slidable on the regulating surface of the regulating member in a direction perpendicular to the sheet width direction in accompaniment to sliding of the regulating member.

5. The sheet feed cassette according to claim 2, further comprising a sliding member located at the second end portion of the auxiliary member and configured to slide on the regulating surface of the regulating member in a direction perpendicular to the sheet width direction.

6. The sheet feed cassette according to claim 1, wherein the regulating member includes a pair of first and second regulating walls and faces each other in the sheet width direction, the first and second regulating walls each have the regulating surface, and the auxiliary member includes a pair of first and second auxiliary plates, the first auxiliary plate being configured to be in contact with the regulating surface of the first regulating wall, the second auxiliary plate being in contact with the regulating surface of the second regulating wall.

7. The sheet feed cassette according to claim 6, wherein each of the first auxiliary plate and the second auxiliary plate includes:

a first end portion located downstream in the sheet feed direction; and a second end portion located upstream in the sheet feed direction and in contact with a corresponding one of the first regulating wall and the second regulating wall;

the supported portion includes a first supported portion and a second supported portion, the first supported portion is located between the first end portion of the first auxiliary plate and the second end portion of the first auxiliary plate, the second supported portion is located between the first end portion of the second auxiliary plate and the second end portion of the second auxiliary plate, the sheet feed cassette further comprises an urging member configured to urge the auxiliary member, and the first end portion of the first auxiliary plate is connected to the first end portion of the second auxiliary plate through the urging member so that the second end portions of the first and second auxiliary plates turn about the respective supported portions to push the respective restricting surfaces of the first and second regulating walls.

8. The sheet feed cassette according to claim 1, wherein the auxiliary member is located on a lower surface of the sheet loading plate.

9. A sheet feeder comprising:

the sheet feed cassette according to claim 1;

a feed member configured to feed a sheet of the sheet sheaf loaded in the sheet feed cassette; and a sheet feed cassette accommodating section configured to accommodate the sheet feed cassette.

10. An image forming apparatus comprising:

the sheet feeder according to claim 9; and an image forming section configured to form an image on a sheet fed from the sheet feeder.

11. A sheet feed cassette comprising:

a cassette main body with an open top end that includes a bottom plate and side walls standing up from the bottom plate and that is configured to store a sheet sheaf of one or more sheets;

a sheet loading plate supported in a tiltable manner about an upstream end of the bottom plate in a sheet feed direction and having an opening and a support surface that supports the sheet sheaf;

a regulating member that is located on the bottom plate such as to protrude upward from the support surface of the sheet loading plate through the opening of the sheet loading plate, that is configured to be slidable within the opening in a sheet width direction perpendicular to the sheet feed direction, and that regulates the sheet sheaf by coming into contact with an edge of the sheet sheaf in the sheet width direction; and an auxiliary member supported by the sheet loading plate and in contact with the regulating member, wherein the auxiliary member has an elongated shape, and the auxiliary member includes:

a first end portion located downstream in the sheet feed direction;

a second end portion located upstream in the sheet feed direction and in contact with the regulating member; and a supported portion located between the first end portion and the second end portion and supported by the sheet loading plate, the auxiliary member is turnable in parallel to the support surface of the sheet loading plate about the supported portion as a center, the auxiliary member turns in accompaniment to sliding of the regulating member, and the auxiliary member supports a part of the sheet sheaf located over the opening.

12. The sheet feed cassette according to claim 11, further comprising an urging member configured to urge the auxiliary member, wherein the urging member urges the first end portion of the auxiliary member to turn the second end portion of the auxiliary member so that the second end portion of the auxiliary member pushes a side surface of the regulating member.

13. The sheet feed cassette according to claim 11, wherein the second end portion of the auxiliary member is configured to be slidable on a side surface of the regulating member in a direction perpendicular to the sheet width direction in accompaniment to sliding of the regulating member.

14. The sheet feed cassette according to claim 11, further comprising a sliding member located at the second end portion of the auxiliary member and configured to slide on a side surface of the regulating member in a direction perpendicular to the sheet width direction.

15. The sheet feed cassette according to claim 11, wherein the regulating member includes a pair of first and second regulating walls facing each other in the sheet width direction, and the auxiliary member includes a pair of first and second auxiliary plates, the first auxiliary plate being configured to be in contact with the first regulating wall, the second auxiliary plate being in contact with the second regulating wall.

16. The sheet feed cassette according to claim 15, wherein each of the first auxiliary plate and the second auxiliary plate includes:

a first end portion located downstream in the sheet feed direction;

a second end portion located upstream in the sheet feed direction and in contact with a corresponding one of the first regulating wall and the second regulating wall; and a supported portion located between the first end portion and the second end portion and supported by the sheet loading plate, the sheet feed cassette further comprises an urging member configured to urge the auxiliary member, and the first end portion of the first auxiliary plate is connected to the first end portion of the second auxiliary plate through the urging member so that the second end portions of the first and second auxiliary plates turn about the respective supported portions to push respective side surfaces of the first and second regulating walls.

17. The sheet feed cassette according to claim 11, wherein the auxiliary member is located on a lower surface of the sheet loading plate.

18. A sheet feeder comprising:

the sheet feed cassette according to claim 11;

a feed member configured to feed a sheet of the sheet sheaf loaded in the sheet feed cassette; and a sheet feed cassette accommodating section configured to accommodate the sheet feed cassette.

19. An image forming apparatus comprising:

the sheet feeder according to claim 18; and an image forming section configured to form an image on a sheet fed from the sheet feeder.

* * * * *